United States Patent [19]

Tisch

[11] Patent Number: 4,856,474

[45] Date of Patent: Aug. 15, 1989

[54] VALVE CONTROL DEVICE

[75] Inventor: Siegfried Tisch, Gerlingen, Fed. Rep. of Germany

[73] Assignee: INA Walzlager Schaeffler KG, Fed. Rep. of Germany

[21] Appl. No.: 159,270

[22] Filed: Feb. 23, 1988

[30] Foreign Application Priority Data

Apr. 9, 1987 [DE] Fed. Rep. of Germany ..... 3712020

[51] Int. Cl.[4] ..... F02D 9/06

[52] U.S. Cl. ..... 123/323

[58] Field of Search ..... 123/321, 323

[56] References Cited

U.S. PATENT DOCUMENTS

| | | | |
|---|---|---|---|
| 3,525,317 | 8/1970 | Muir | 123/320 |
| 3,786,792 | 1/1974 | Pelizzoni et al. | 123/321 |
| 4,158,348 | 6/1979 | Mason et al. | 123/321 |
| 4,333,430 | 6/1982 | Rosquist | 123/321 |
| 4,662,332 | 5/1987 | Bergmann et al. | 123/321 |

FOREIGN PATENT DOCUMENTS

| | | | |
|---|---|---|---|
| 407058 | 8/1944 | Italy | 123/323 |
| 1078 | 2/1916 | Netherlands | 123/323 |
| 8707323 | 12/1987 | PCT Int'l Appl. | 123/323 |

*Primary Examiner*—Noah P. Kamen

*Attorney, Agent, or Firm*—Bierman and Muserlian

[57] ABSTRACT

A valve control device for a cam-shaft controlled exhaust valve of a cylinder of a motor vehicle internal combustion engine with an exhaust cutoff brake wherein an actuator closes a throttle valve in the exhaust of the cylinder to initiate a braking operation, characterized in that a hydraulic valve clearance compensation element is arranged between the cam-shaft and the exhaust valve whereby an adjusting piston is guided in a cylindrical body and is loaded by a return spring and a control element is provided to retain the adjusting piston relative to cylindrical body during braking in the adjusted position respectively reached at the beginning of the braking operation wherein the control element acts upon the hydraulic valve clearance compensation element during braking operation with a force which exceeds or at least corresponds to the force of the return spring of the hydraulic valve clearance compensation element and counteracts the latter.

10 Claims, 6 Drawing Sheets

VALVE CONTROL DEVICE

STATE OF THE ART

Valve control devices for a cam-shaft controlled exhaust valve of a cylinder of an internal combustion engine of a motor vehicle with an exhaust cutoff wherein an actuator closes a throttle valve in the exhaust of the cylinder to initiate the braking operation are known. In the known internal combustion engines of motor vehicles with an exhaust cutout brake, the valve control device of the exhaust valves does not include an automatic adjustment of the valve play. There are known hydraulic valve clearance compensation elements in which an adjusting piston is guided in a cylinder body and loaded by a return spring with the valve element being arranged between the cam-shaft and a valve of an internal combustion engine.

Known hydraulic valve clearance compensation elements cannot be used in internal combustion engines with an exhaust cutout brake because the exhaust valve flutters in the braking operation which results in a readjustment of a hydraulic valve clearance compensation element. This, however, would prevent the exhaust valve from completely closing during the subsequent running operation, thus damaging the exhaust valve.

OBJECTS OF THE INVENTION

It is an object of the invention to provide a valve control device of the said type which attains in an internal combustion engine with exhaust cutout break a hydraulic valve clearance compensation element without requiring a valve play compensation during the braking operation.

This and other objects and advantages of the invention will become obvious from the following detailed description.

THE INVENTION

The valve control device of the invention for a cam-shaft controlled exhaust valve of a cylinder of a motor vehicle internal combustion engine with an exhaust cutout brake wherein an actuator closes a throttle valve in the exhaust of the cylinder to initiate a braking operation, is characterized in that a hydraulic valve clearance compensation element is arranged between the cam-shaft and the exhaust valve whereby an adjusting piston is guided in a cylinder body and is loaded by a return spring and a control element is provided to retain the adjusting piston relative to cylindrical body during braking in the adjusted position respectively reached at the beginning of the braking operation. By this construction, during the running operation, an adjustment of the valve is attained by the hydraulic valve clearance compensation element while during the braking operation, the valve clearance compensation element remains inactive.

During the braking operation, the control element applies a force on the hydraulic valve clearance compensation element which exceeds or at least corresponds to the force of the return spring of the valve clearance compensation element and counteracts the latter. Thus, during braking operation, no change of the adjusted position of the adjusting piston occurs. When a push rod and a rocker arm are arranged between the valve element, the control element preferably acts upon the rocker arm or the push rod or the adjusting piston.

According to one embodiment of the invention, the control element locks the adjusting piston relative to the cylinder body during the braking operation and the control element is then preferably integrated in the valve clearance composition element.

Referring now to the drawings.

Figure 1:
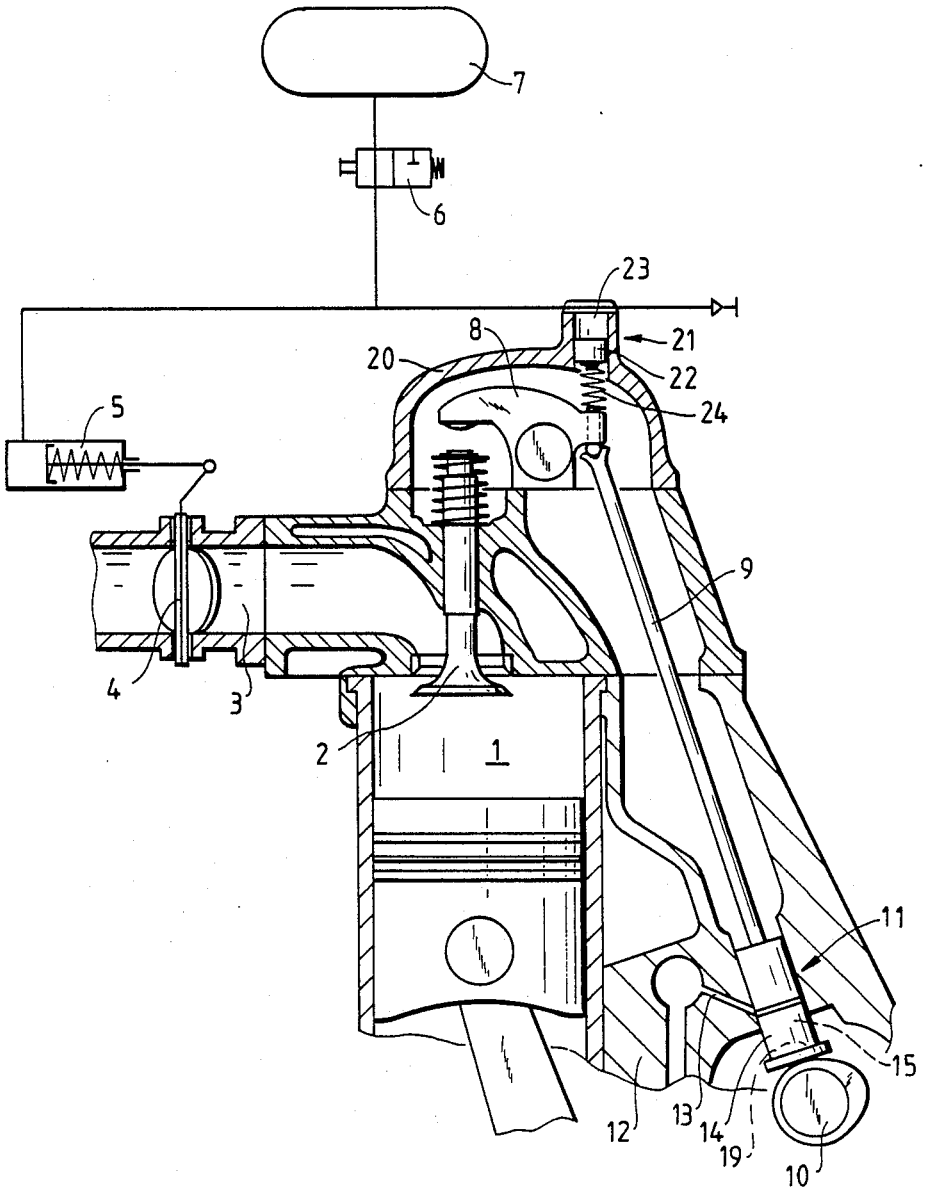
FIG. 1 is a schematic view of the valve control device in an internal combustion engine with an exhaust cutout brake wherein the control element acts upon a rocker arm.

Referring to FIG. 1, an internal combustion engine comprises a cylinder (1) with an exhaust valve (2) and arranged in an exhaust duct (3) is a throttle valve (4) which is actuated by a pneumatic working cylinder (5). Connected to the working cylinder (5) via an engine brake valve (6) is a compressed air reservoir (7). Associated with the exhaust valve (2) is a rocker arm (8) which is coupled to a push rod (9) and a hydraulic valve clearance compensating element (11) is supported for displacement within the engine block (12) between the end of the push rod (9) facing away from the rocker arm (8) and a cam-shaft (10) and is connected via a bore (13) with the compressed oil of the engine.

The valve clearance compensation element (11) includes a cylindrical body (14) in which an adjusting piston (15) is guided and provided in the adjusting piston (15) is an oil pressure chamber (16) connected via channels (17) with the bore (13) and thus with the oil pressure of the engine. Arranged between the adjusting piston (15) and the cylinder body (14) are a check valve (18) and a return spring (19) (see FIGS. 6 to 8). Such valve clearance compensation elements (11) are conventional structural parts. The cylindrical body (14) bears against the cam-shaft (10) and the push rod (9) is secured to the adjusting piston (15). Provided at a cylinder head (20) below which the rocker arm (8) is arranged is a control part (21) which in FIG. 1 includes a control piston (22) guided in a pressure chamber (23). The pressure chamber (23) is also linked to the engine brake valve (6) and arranged between the control piston (22) and the rocker arm (8) is a compression spring (24).

The mode of operation of the described control device according to FIG. 1 is as follows: FIG. 1 shows the engine brake in operation. The engine brake valve (6) is actuated so that the throttle valve (4) actuated by the working cylinder (6) maintains the exhaust duct (3) closed and the control piston (22) pushes the compression spring (24) onto the rocker arm (8) in opposition to the direction of force of the return spring (19). The exhaust valve (2) flutters during braking operation but this flutter movement is not followed by the rocker arm (8) which is actuated by the cam-shaft (10) via the hydraulic valve clearance compensation element (11) and push rod (9). The force applied on the rocker arm (8) via the compression spring (24) and the control piston (22) is of such a magnitude that the return spring (19) cannot relax and this guarantees that the adjusted position of the adjusting piston (15) is not changed relative to the cylindrical body (14) compared to the state attained before initiating the braking operation.

When switching off the engine brake valve (6), the throttle valve (4) opens and the control piston (22) is relieved and pushed back into the pressure chamber. The rocker arm (8) bears against the exhaust valve (2) and exhaust valve (2) is now controlled by the camshaft (10) via the hydraulic valve clearance compensation element (11), the push rod (9) and the rocker arm (8). The force of the compression spring (24) by itself is less than the force of the return spring (19) so that now the hydraulic valve clearance compensation element (11) works in running operation in known manner.

Figure 2:
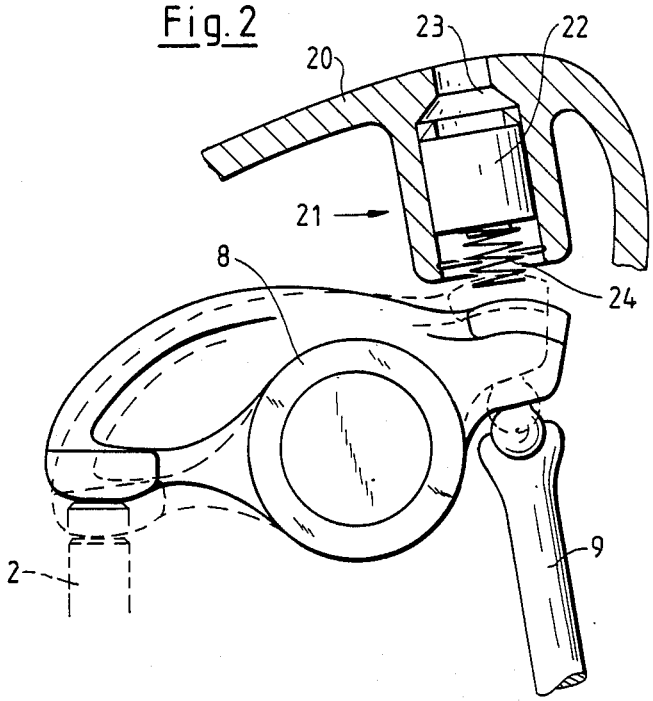
FIGS. 2, 3 and 4 are partial views of other embodiments according to FIG. 1.

The embodiment of FIG. 1 is based on the fact that the compression spring (24) bears against the rocker arm (8) also during running operation. In contrast thereto, FIG. 2 illustrates an embodiment in which the compression spring (24) is designed so that it bears against the rocker arm (8) only during the braking operation but not during the running operation. FIG. 2 illustrates the running operation wherein the compression spring (24) is lifted off the rocker arm (8) at least in the base circle phase. This simplifies the selection and dimensioning of the compression spring (24).

Figure 3:
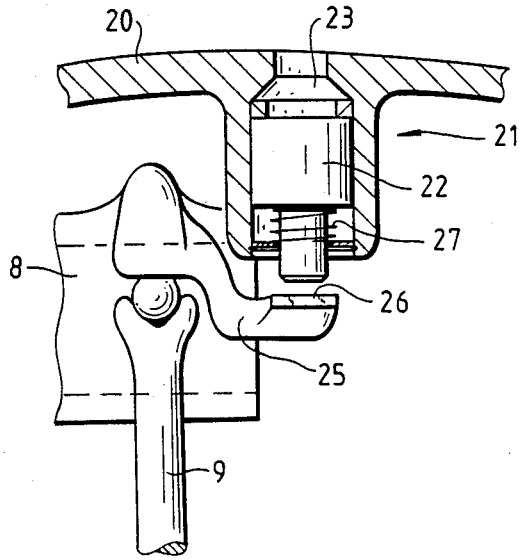

In the embodiment of FIG. 3, an actuating arm (25) with a stop surface (26) is arranged at the rocker arm (8) and opposing the stop surface (26) is the control piston (22) of the control part (21). The latter is pushed by a return spring (27) in its initial position of the running operation which is shown in FIG. 3. There is no spring provided between the control piston (22) and the stop surface (26). In case of the braking operation, the pressure chamber (23) is pneumatically acted upon so that the control piston (22) abuts the stop surface (26) and thus applies pressure on the self-adjusting valve element via the push rod (9) so that the adjusting piston (15) is prevented by the action of the return spring (19) from readjusting relative to the cylinder body (14). The pneumatic connection of the pressure chamber (23) acts as a gas pressure spring which allows the movement of the rocker arm (8) caused by the cam-shaft (10) in the braking operation.

Figure 4:
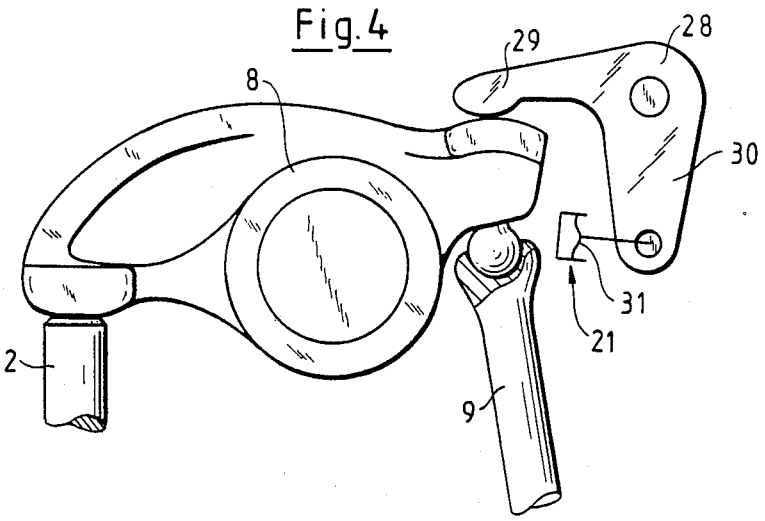

In the embodiments of FIGS. 1 to 3, the control part (21) directly acts on the rocker arm (8) but in the embodiment of FIG. 4, an intermediate member in the form of an angle lever (28) is provided between the control part (21) and the rocker arm (8) and it has one arm (29) bearing against the rocker arm (8) and another arm (30) being acted upon by the control part (21). In FIG. 4, the control part (21) is indicated as a pneumatically or hydraulically actuated member arrangement (31). The arm (29) may also bear against the rocker arm (8) with a roller supported in sliding manner or by rolling contact.

Figure 5:
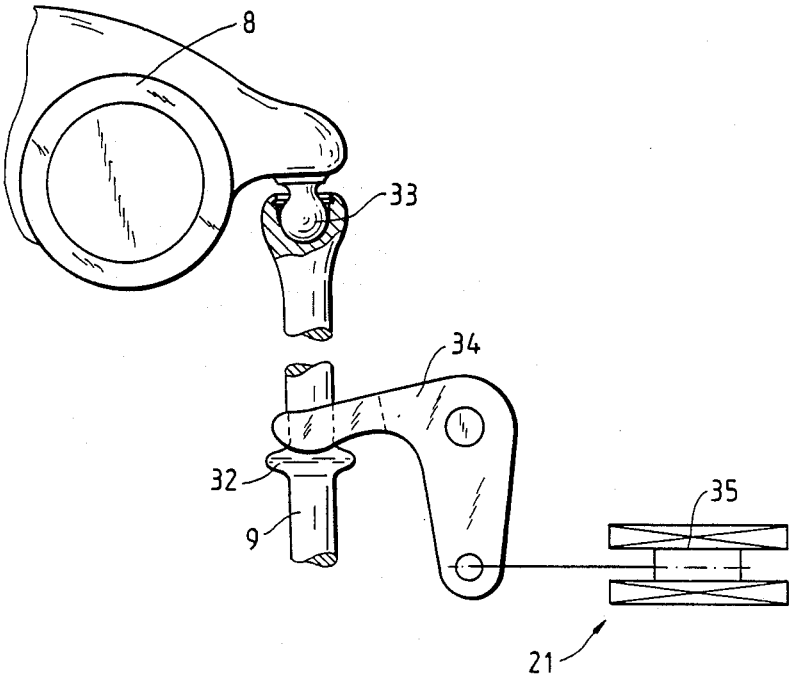
FIG. 5 is a partial view of an embodiment in which the control element acts upon a push rod.

In the embodiment of FIG. 5, the push rod (9) is provided with a collar (32) and the upper end of the push rod (9) is attached to a head (33) of the rocker arm (8). Bearing against the collar (32) is an intermediate member in the form of a swingably supported fork (34) which is acted upon by the control element (21). FIG. 5 shows an electromagnet (35) as control part (21) which electromagnet (35) is dimensioned so that the force exerted thereby during the braking operation maintains the adjusted position of the adjusting piston (15) relative to the cylinder body (14) during the beginning of the braking operation. The fork (34) may also be arranged so that it directly bears against the adjusting piston (15).

The arrangement of the actuator (21) and also of the intermediate members (28,34) is designed to depend on the special prevailing conditions. Depending on the drive system provided for the control mechanism of the throttle valve (4), in accordance with the control mechanism a pneumatically, hydraulically or electromagnetically working control part (21) is employed. In case of a pure mechanical drive of the throttle valve (4), a mechanical control element (21) is thus accordingly used.

Figure 6:
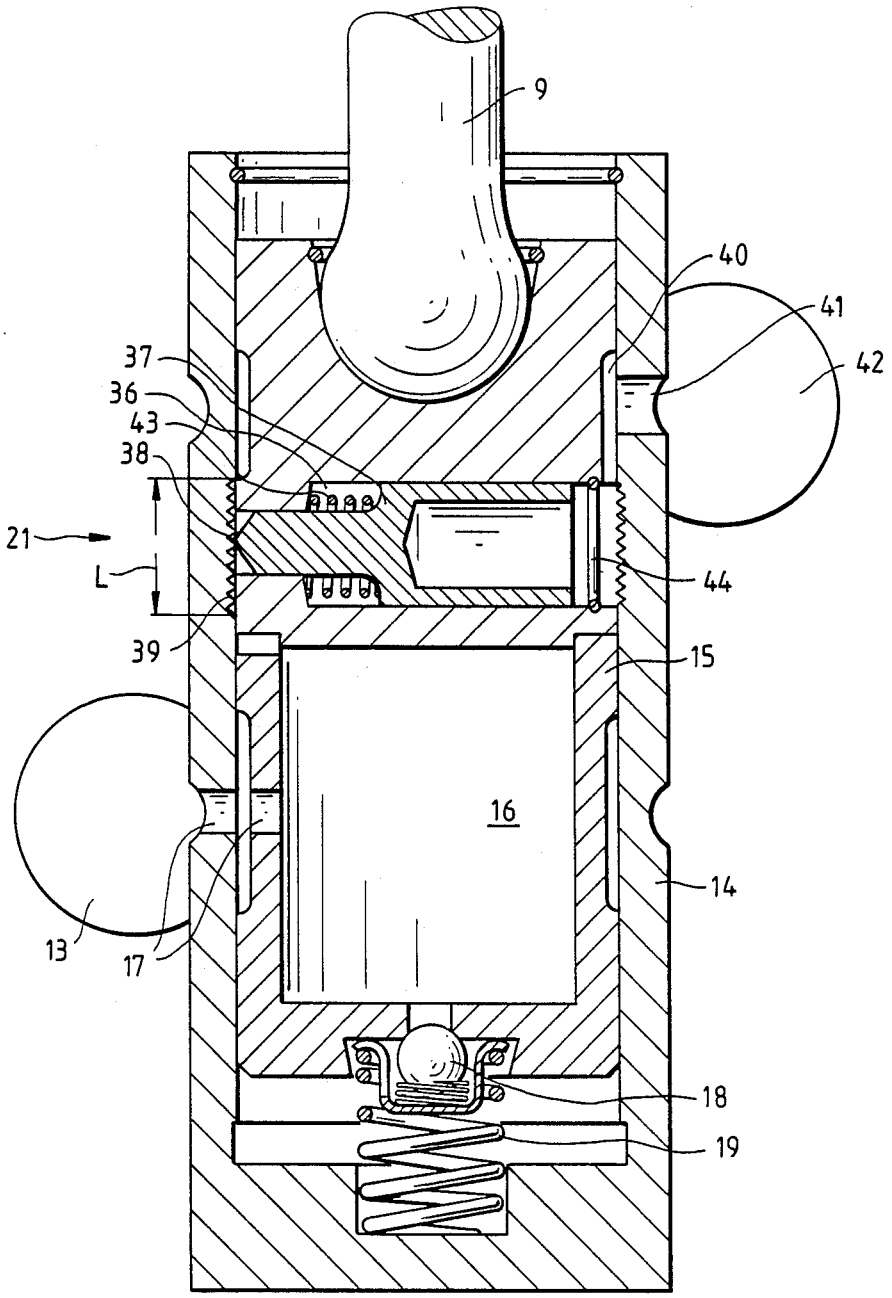
FIG. 6 is a cross-section of a hydraulic valve clearance compensation element with an integrated control element.
Figure 7:
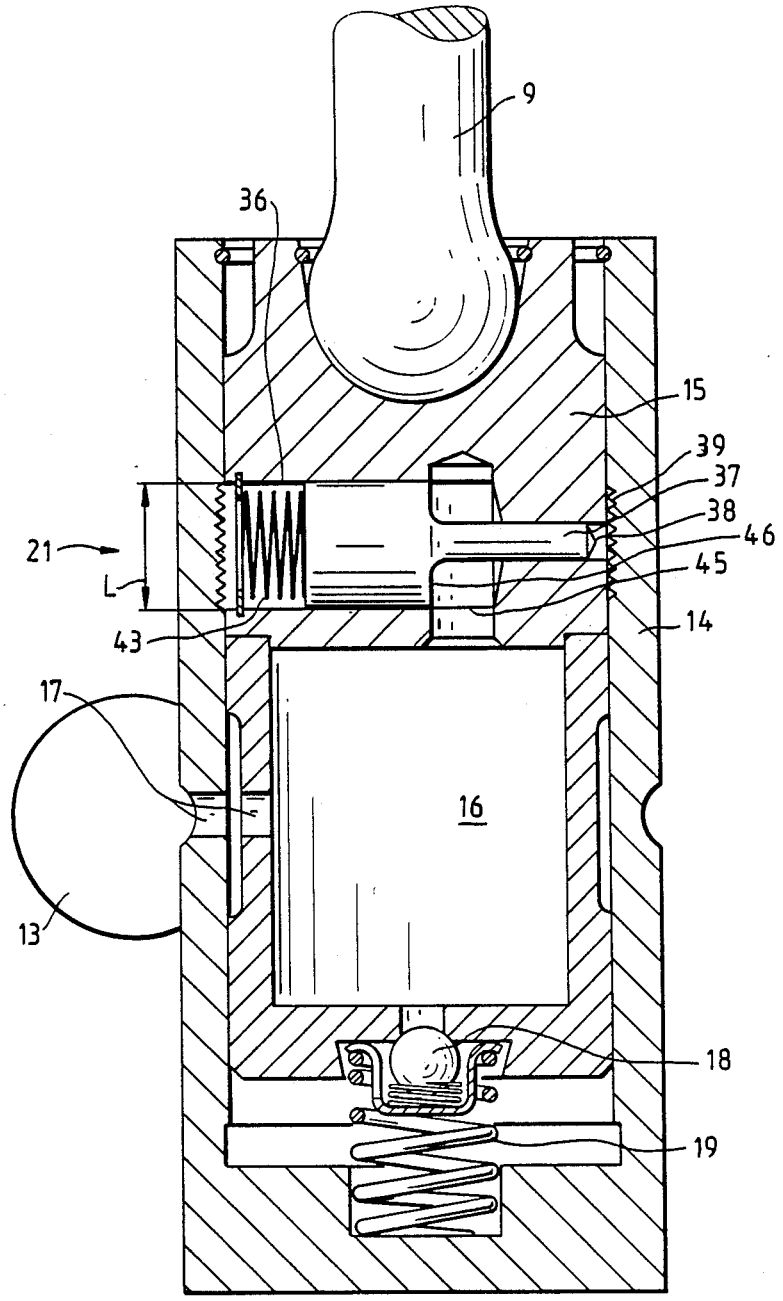
FIGS. 7 and 8 are other embodiments according to FIG. 6.
Figure 8:
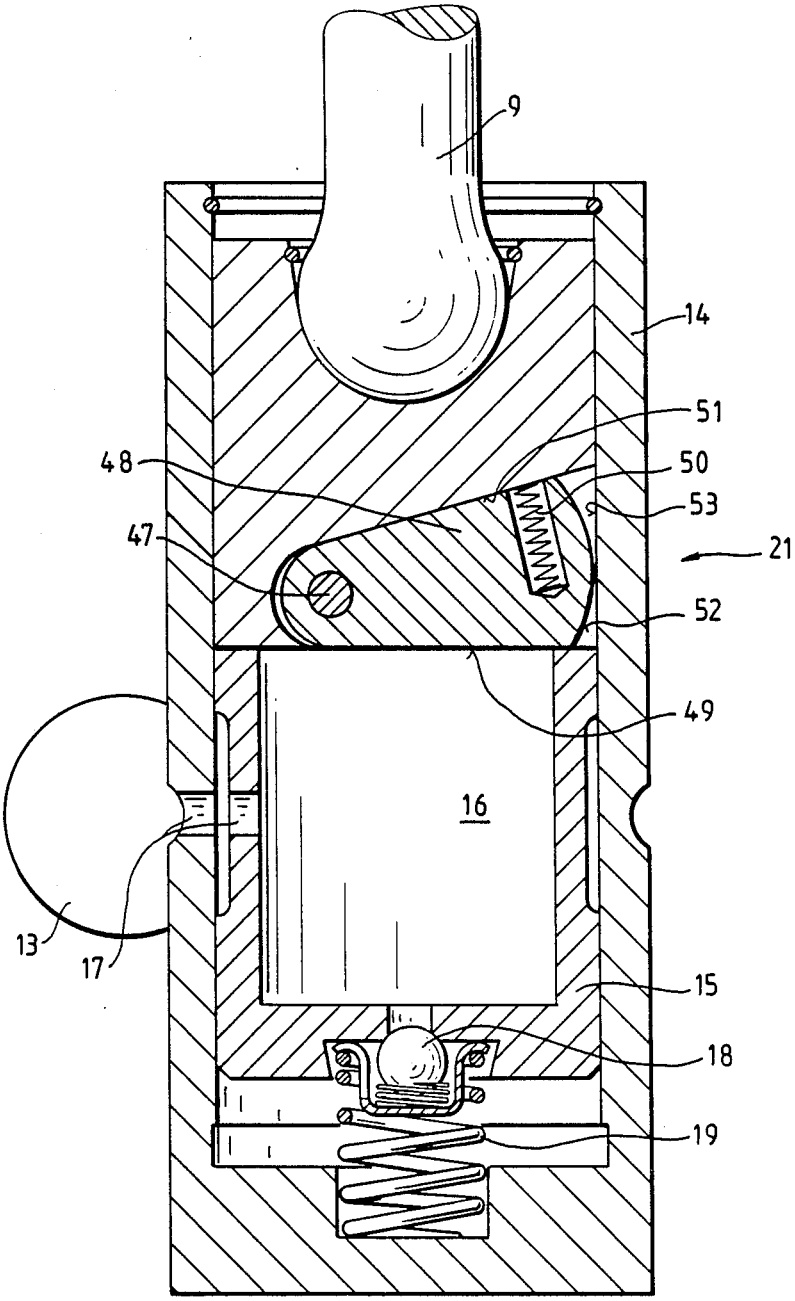

In the embodiments of FIGS. 6, 7 and 8, the control part (21) is integrated with the hydraulic valve clearance compensation element (11). In this case, the control part (21) does not act on the rocker arm (8) or the push rod (6) but acts directly between the adjusting piston (15) and the cylinder body (14). In the embodiment of FIG. 6, a locking bolt (37) is guided for displacement in a transverse bore (36) of the adjusting piston (15) and includes a prong (38) at its one end. The cylinder body (14) has internal gear teeth (39), the length (L) of which at least corresponds to the possible adjusting stroke of the adjusting piston (15) in the cylinder body (14). The transverse bore (36) communicates with a control oil line (42) via an annular channel (40) of the adjusting piston (15) and a bore (41) in the cylinder body (14). The locking bolt (37) is loaded by a compression spring (43) in the direction toward a stop ring (44).

The mode of operation of the control element is as follows: During the running operation, the control oil line (42) is pressureless whereby the compression spring (43) urges the locking bolt (37) against the stop ring (44) and its prong (38) does not engage the gear teeth (39). By actuating the engine brake valve (6), the control oil line (42) is under pressure and the locking bolt (37) is thus pushed in opposition to the force of the compression spring (43) with its prong (38) into the gear teeth (39) so that the adjusting piston (15) is prevented from movement relative to the cylinder body (14). Thus, an adjusted position of the adjusting piston (15) is fixed in the cylindrical body (14) prior to the braking operation as long as the braking operation takes place. Depending on the adjusted position attained prior to a braking operation, the prong (38) engages the gear teeth (39).

By structuring the braking unit so that no oil pressure exists during the braking operation, the control part (21) of FIG. 6 may be designed so that the prong (38) of the locking bolt (37) is urged into gear teeth (39) during the braking operation by the compression spring (43). During the running operation, the locking bolt (37) is then disengaged from the gear teeth by the oil pressure.

In contrast to the embodiment of FIG. 6, the embodiment of FIG. 7 is not provided with a control oil line (42) and the adjusting piston (15) is provided with a blind bore (45) open toward the oil pressure chamber (16) and intersecting the tranverse bore (36). The locking bolt (37) includes an actuating surface (46) facing the blind bore (45) and the compression spring (43) urges the prong (38) of the locking bold (37) in the direction of the gear teeth (39).

As long as the oil pressure chamber (16) and thus the blind bore (45) is in the running operation under pressure, the locking bolt (37) is held via its actuating surface (46) in opposition the force of the pressure spring so that its prong (38) does not engage the gear teeth (39). During the braking operation, the oil pressure of the oil pressure chamber is cut off and compression spring (43) then urges the prong (38) into the gear teeth

(39) so that the adjusting piston (15) is locked relative to the cylinder body (14).

Also during shutting down on the engine, the pressure drops in oil pressure chamber (16) so that the adjusting piston (15) is then also locked relative to the cylinder body (14). At engine shutdown, the adjusting piston (15) is prevented from moving in either direction and thus reduces rattling noises during any subsequent cold start of the engine.

In the embodiment of FIG. 8, a locking cam (48) is tiltably supported by a transverse shaft (47) at the adjusting piston (15) and the locking cam (48) is exposed with one lateral face (49) to the oil pressure chamber (16). Arranged in the locking cam (48) is a compression spring (50) which is supported by a surface (51) of the adjusting piston (15) opposing the lateral face (49) and an end face (52) of the locking cam (48) is sector-shaped and opposes an inner surface (53) of the cylinder body (14).

During the running operation of the engine, the oil pressure chamber (16) is under pressure which is applied on the lateral face (49) of the locking cam (48), and the locking cam (48) is retained in opposition to the force of the compression spring (50) in the position as shown in FIG. 8 in which the end face (52) is prevented from contacting the inner surface (53). The adjusting piston (15) is thus adjustable with respect to the cylindrical body (14).

During the braking operation, the oil pressure of the oil pressure chamber (16) is cut off and the compression spring (50) swings the locking cam (48) so that its end face (52) abuts the inner surface (53). Thus, the adjusting piston (15) is locked in self-locking manner in the respective position relative to the cylindrical body (14). Only upon renewed buildup of pressure in the oil pressure chamber (16) can the adjusting piston (15) be freed again relative to the cylindrical body (14). The same is true in case the engine is shut down. Consequently, as in the embodiment of FIG. 7, a rattling of the device during cold start is diminished. In contrast to the control part (21) of FIGS. 6 and 7, the control part (21) of FIG. 8 works continuously. In case the direct application of the pressure onto the lateral face (49) is insufficient, the adjusting piston (15) may support an additional piston which is acted upon by pressure from the oil pressure from the oil pressure chamber and acts on the lateral face (49).

Various modifications of the valve control device of the invention may be made without departing from the spirit or scope thereof and it should be understood that the invention is intended to be limited only as defined in the appended claims.

What I claim is:

1. A valve control device for a cam-shaft controlled exhaust valve of a cylinder of a motor vehicle internal combustion engine with an exhaust cutoff brake wherein an actuator closes a throttle valve in the exhaust of the cylinder to initiate a braking operation, characterized in that a hydraulic valve clearance compensation element is arranged between the cam-shaft and the exhaust valve whereby an adjusting piston is guided in a cylindrical body and is loaded by a return spring and a control element is provided to retain the adjusting position respectively reached at the beginning of the braking operation wherein the control element acts upon the hydraulic valve clearance compensation element during braking operation with a force which exceeds or at least corresponds to the force of the return spring of the hydraulic valve clearance compensation element and counteracts the latter.

2. A valve control device of claim 1 wherein the spring force of the control element is defined by a pneumatic chamber acting as a gas pressure spring.

3. A valve control device of claim 1 wherein the control element acts between an engine block-fixed part and a control part comprised of at least one element selected from the group consisting of a rocker arm, a push rod and an adjusting piston of the control device.

4. A valve control device of claim 1 wherein the control element is spaced from the control part during running operation.

5. A valve control element device of claim 1, characterized in that the control element includes a compression spring and a control piston guided in a pressure chamber whereby the force applied on the hydraulic valve clearance compensation element is composed of a precompressed spring force and a force added during braking operation wherein the precompressed spring force is smaller than the force of the precompressed return spring of the hydraulic valve clearance compensation element.

6. A valve control device for a cam-shaft controlled exhaust valve of a cylinder of a motor vehicle internal combustion engine with an exhaust cutoff brake wherein an actuator closes a throttle valve in the exhaust of the cylinder to initiate a braking operation, characterized in that a hydraulic valve clearance compensation element is arranged between a cam-shaft and the exhaust valve whereby an adjusting piston is guided in a cylindrical body and is loaded by a return spring and a control element is provided to retain the adjusting piston relative to cylindrical body during braking in the adjusted position respectively reached at the beginning of the braking operation wherein the control element acts upon the hydraulic valve clearance compensation element during braking operation with a force which exceeds or at least corresponds to the force of the return spring of the hydraulic valve clearance compensation element and counteracts the latter and an intermediate member is arranged between the control element and the control part is comprised of at least one memeber of the group consisting of a rocker arm, a push rod or an adjusting piston.

7. A valve control device of claim 6 wherein the control element includes a locking bolt slidable within the adjusting piston and engaging a gear-teeth of the cylindrical body in a form-locking manner during the braking operation.

8. A valve control device of claim 6 wherein the control element includes a locking cam swingably supported in the adjusting piston and bearing against the cylindrical body in a self-locking manner during the braking operation.

9. A valve control device of claim 6 wherein the control element is retained in the unlocking position during running operation by the oil pressure of the hydraulic valve clearance compensation element and brought into locked position by a spring during the braking operation.

10. A valve control device for a cam-shaft controlled exhaust valve of a cylinder of a motor vehicle internal combustion engine with an exhaust cutoff brake wherein an actuator closes a throttle valve in the exhaust of the cylinder to initiate a braking operation, characterized in that a hydraulic valve clearance compensation element is arranged between the cam-shaft and the exhaust valve whereby an adjusting piston is guided in a cylindrical body and is loaded by a return spring and a control element is provided to retain the adjusting piston relative to cylindrical body during braking in the adjusted position respectively reached at the beginning of the braking operation wherein the control element acts upon the hydraulic valve clearance compensation element during braking operation with a force which exceeds or at least corresponds to the force of the return spring of the hydraulic valve clearance compensation element and counteracts the latter wherein during a braking operation, the control element locks the adjusting piston of the hydraulic valve clearance compensation element relative to its cylindrical body.

* * * * *